US012357044B1

(12) United States Patent
West

(10) Patent No.: US 12,357,044 B1
(45) Date of Patent: Jul. 15, 2025

(54) ADAPTIVE CLOTHING ASSEMBLY

(71) Applicant: Lonnie West, Minneapolis, MN (US)

(72) Inventor: Lonnie West, Minneapolis, MN (US)

( * ) Notice: Subject to any disclaimer, the term of this patent is extended or adjusted under 35 U.S.C. 154(b) by 0 days.

(21) Appl. No.: 18/620,816

(22) Filed: Mar. 28, 2024

(51) Int. Cl.
*A41D 13/12* (2006.01)

(52) U.S. Cl.
CPC ..... *A41D 13/129* (2013.01); *A41D 13/1236* (2013.01); *A41D 13/1254* (2013.01); *A41D 13/1272* (2013.01)

(58) Field of Classification Search
CPC ..... A41D 13/129; A41D 13/1236; A41D 13/1254; A41D 13/1272
See application file for complete search history.

(56) References Cited

U.S. PATENT DOCUMENTS 3,800,330 A * 4/1974 Bowcut ..... A41D 1/08 2/227
4,914,756 A * 4/1990 Grassick ..... A41D 13/129 2/238
5,249,832 A * 10/1993 Leonardz ..... A47G 25/902 223/111
5,822,802 A * 10/1998 Chou ..... A41D 13/1254 2/235
6,032,996 A * 3/2000 Kogen ..... A47G 25/902 24/40
6,243,878 B1 6/2001 Khemka
6,892,399 B1 * 5/2005 Rocha ..... A41D 1/06 2/234
8,205,270 B2 6/2012 Kato
8,464,365 B1 * 6/2013 Nunn ..... A41D 1/08 2/227
9,622,517 B2 4/2017 Hochman
10,051,900 B2 8/2018 Carryl
10,264,827 B1 * 4/2019 Pettet ..... A44B 19/24
10,342,268 B2 * 7/2019 Collins ..... A41C 1/00
10,420,399 B2 * 9/2019 Reuben ..... A44B 19/262
10,849,370 B2 12/2020 Morgan
10,945,468 B1 3/2021 Hamilton
11,470,900 B1 * 10/2022 Lindquist ..... A41F 9/025
11,659,873 B2 5/2023 Gonzalez
2002/0040496 A1 * 4/2002 Blaire ..... A41D 1/06 2/227
2003/0024028 A1 * 2/2003 Sleesen ..... A41D 13/0158 2/2.17
2004/0128731 A1 * 7/2004 Marty ..... A47G 9/086 2/69
2007/0204376 A1 * 9/2007 Nunn ..... A41D 1/08 2/69
2013/0298311 A1 * 11/2013 Gerenda ..... A41F 9/025 24/68 E
2014/0096304 A1 * 4/2014 Martinez ..... A41F 9/02 2/79

(Continued)

*Primary Examiner* — Khaled Annis

(57) ABSTRACT

An adaptive clothing assembly for facilitating access to the legs and crotch of a user with medical issues or mobility restrictions includes a pair of pants having a waist portion coupled to a first leg portion and a second leg portion. A crotch area is positioned between the first leg portion and the second leg portion. An inseam extends across the crotch area and downwardly along each of the first leg portion and the second leg portion. An inseam closure is coextensive with the inseam. The inseam closure is openable to define a continuous break designed to expose both legs and a crotch of the user.

19 Claims, 11 Drawing Sheets

(56) References Cited

U.S. PATENT DOCUMENTS

| | | | | |
|---|---|---|---|---|
| 2015/0020288 | A1* | 1/2015 | Picot | A41D 13/129 2/69 |
| 2017/0295855 | A1* | 10/2017 | Baez | A41D 1/06 |
| 2020/0138220 | A1* | 5/2020 | Denton | A44B 19/262 |
| 2021/0120887 | A1* | 4/2021 | Horak | A41D 11/00 |
| 2022/0361591 | A1* | 11/2022 | Padgett | A41B 9/026 |
| 2022/0378120 | A1* | 12/2022 | Horak | A41B 13/005 |
| 2023/0270185 | A1* | 8/2023 | Gonzalez | A41D 1/065 2/79 |
| 2024/0090691 | A1* | 3/2024 | Hinton | A47G 25/902 |
| 2024/0306741 | A1* | 9/2024 | Blaise | A41D 13/02 |

* cited by examiner

ADAPTIVE CLOTHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pairs of pants and more particularly pertains to a new pair of pants for facilitating access to the legs and crotch of a user with medical issues or mobility restrictions.

(2) Description of Related Art Including Information Disclosed Under 37 CFR 1.97 and 1.98

The prior art relates to pairs of pants. Various adaptive garments, including pants, are disclosed for individuals with medical needs, physical disabilities, or mobility restrictions. For example, some pairs of pants have an elongated fly that extends from the front waistband to the crotch area to facilitate access to the crotch of the user. Some references even disclose a fly that extends all the way to the rear waistband, to facilitate access to both the crotch and the buttocks of the user. However, the prior art fails to disclose a pair of pants with an inseam that can be opened to facilitate access to the legs and the crotch of the user. Such a garment would be particularly useful for individuals with colostomy bags, catheter bags, or other incontinence aids to facilitate access to the incontinence aids. Such a garment would also be particularly useful for individuals who work with caretakers and medical professionals that need access to the legs and crotch of the user, so that the user does not need to remove the garment for access to the lower portion of the body. The prior art also lacks disclosure of adaptive garments or pants designed to mirror or imitate the look of traditional, non-adaptive men's slacks. Thus, there is a need for an adaptive garment, and particularly a pair of adaptive menswear pants, that has the appearance of traditional slacks. Such a garment would provide greater privacy and dignity for the user.

BRIEF SUMMARY OF THE INVENTION

An embodiment of the disclosure meets the needs presented above by generally comprising a pair of pants having a waist portion that is coupled to a first leg portion and a second leg portion. The first leg portion and the second leg portion extend downwardly from the waist portion wherein the first leg portion is configured to receive a first leg of the user and wherein the second leg portion is configured to receive a second leg of the user. The first leg portion has a first leg portion bottom edge that is distal to the waist portion. The second leg portion has a second leg portion bottom edge that is distal to the waist portion. A crotch area is positioned on the waist portion and extends between the first leg portion and the second leg portion.

An inseam extends across the crotch area and downwardly along each of the first leg portion and the second leg portion. The inseam includes an inseam first end that is positioned above the first leg portion bottom edge. An inseam second end is positioned above the second leg portion bottom edge. The inseam is continuous between the inseam first end and the inseam second end.

An inseam closure is coextensive with the inseam. The inseam closure is openable to define a continuous break along the inseam. The continuous break extends continuously from the inseam first end to the inseam second end wherein the continuous break is configured to selectively expose the first leg, the second leg, and a crotch of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
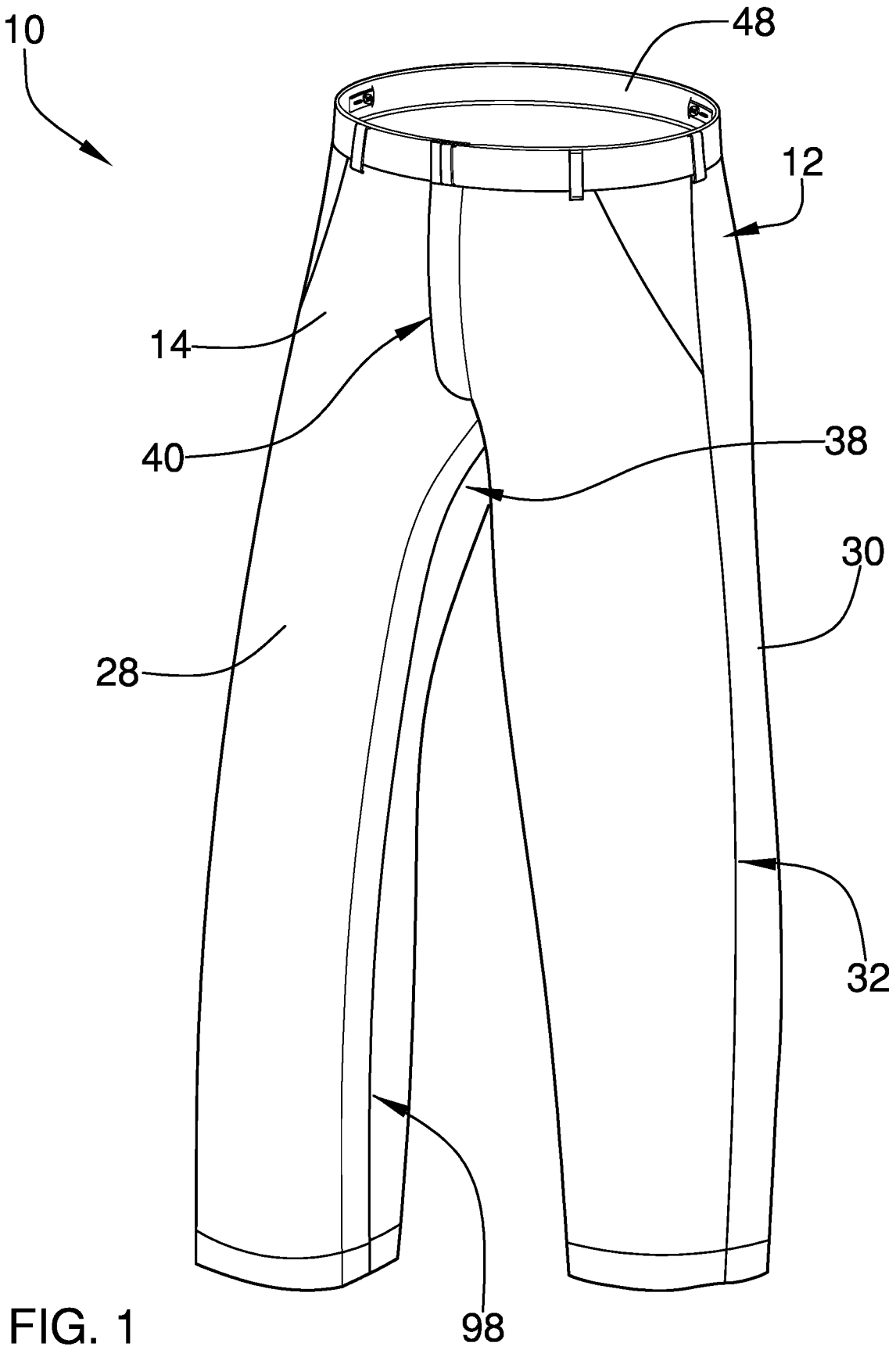
FIG. 1 is a front isometric view of an adaptive clothing assembly according to an embodiment of the disclosure.
Figure 2:
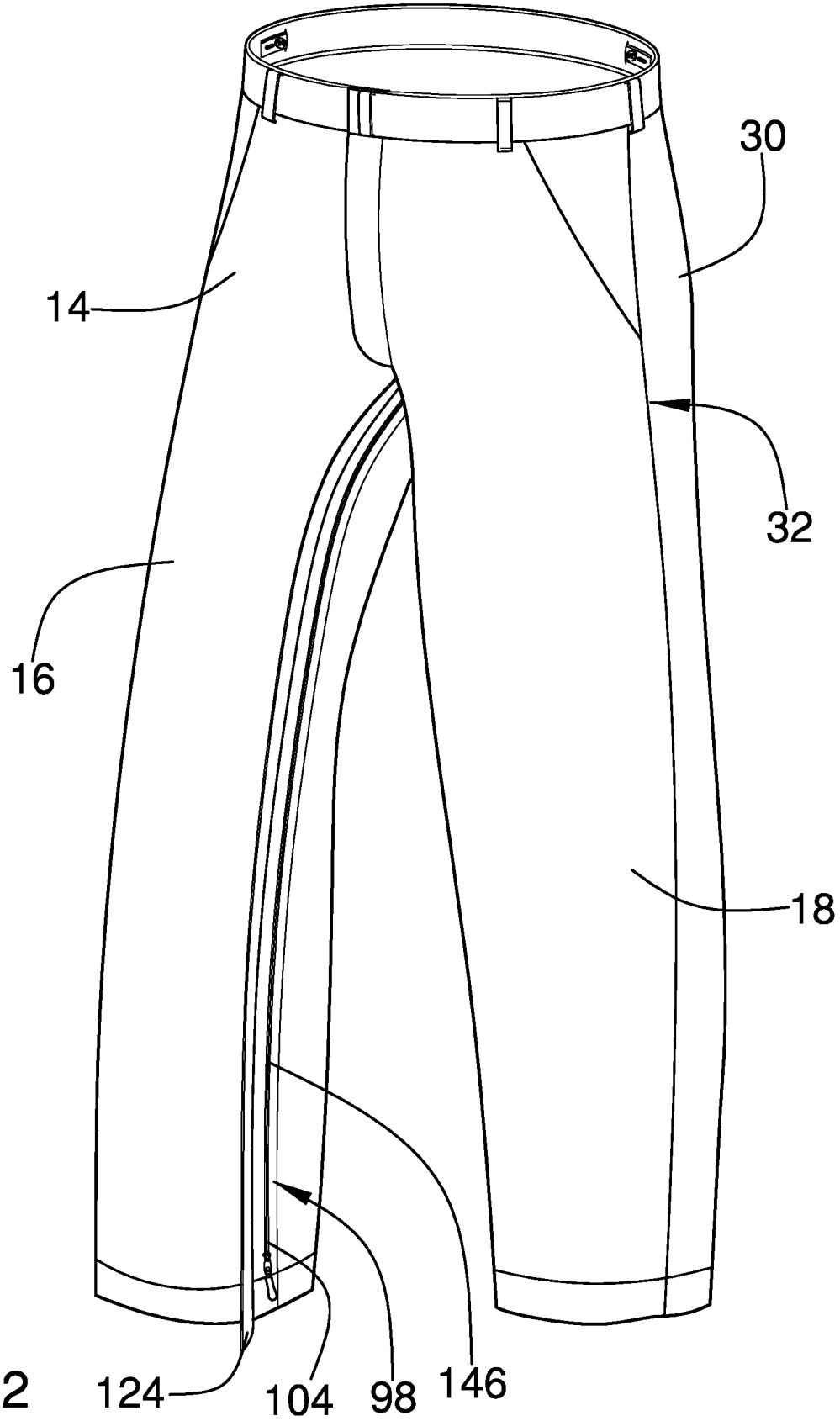
FIG. 2 is a front isometric view of an embodiment of the disclosure.

With reference now to the drawings, and in particular to FIGS. 1 through 11 thereof, a new pair of pants embodying the principles and concepts of an embodiment of the disclosure and generally designated by the reference numeral 10 will be described.

As best illustrated in FIGS. 1 through 11, the adaptive clothing assembly 10 generally comprises a pair of pants 12 having a waist portion 14 that is coupled to a first leg portion 16 and a second leg portion 18 wherein the pair of pants 12 is configured to be positionable over a lower portion of a body 20 of a user 22. The lower portion generally extends downwardly from a waist of the user 22 to a pair of ankles of the user 22. The first leg portion 16 and the second leg portion 18 each extend downwardly from the waist portion 14 wherein the first leg portion 16 is configured to receive a first leg of the user 22 and wherein the second leg portion 18 is configured to receive a second leg of the user 22.

The first leg portion 16 generally has a first leg portion bottom edge 24 that is distal to the waist portion 14. The second leg portion 18 generally has a second leg portion bottom edge 26 that is distal to the waist portion 14. The first leg portion bottom edge 24 is typically aligned with the second leg portion bottom edge 26 wherein a length of the first leg portion 16 is equal to a length of the second leg portion 18. Variations in the length of each of the first leg portion 16 and the second leg portion 18 are contemplated. For example, the pair of pants 12 may be a pair of slacks wherein the first leg portion 16 and the second leg portion 18 are each designed to extend along an entire length of each of the first leg and the second leg of the user 22, respectively, as shown in the drawings. In another example, the pair of pants 12 may be a pair of capris or a pair of shorts with wherein the first leg portion 16 and the second leg portion 18 are each designed to extend along a partial length of each of the first leg and the second leg of the user 22, respectively.

Figure 4:
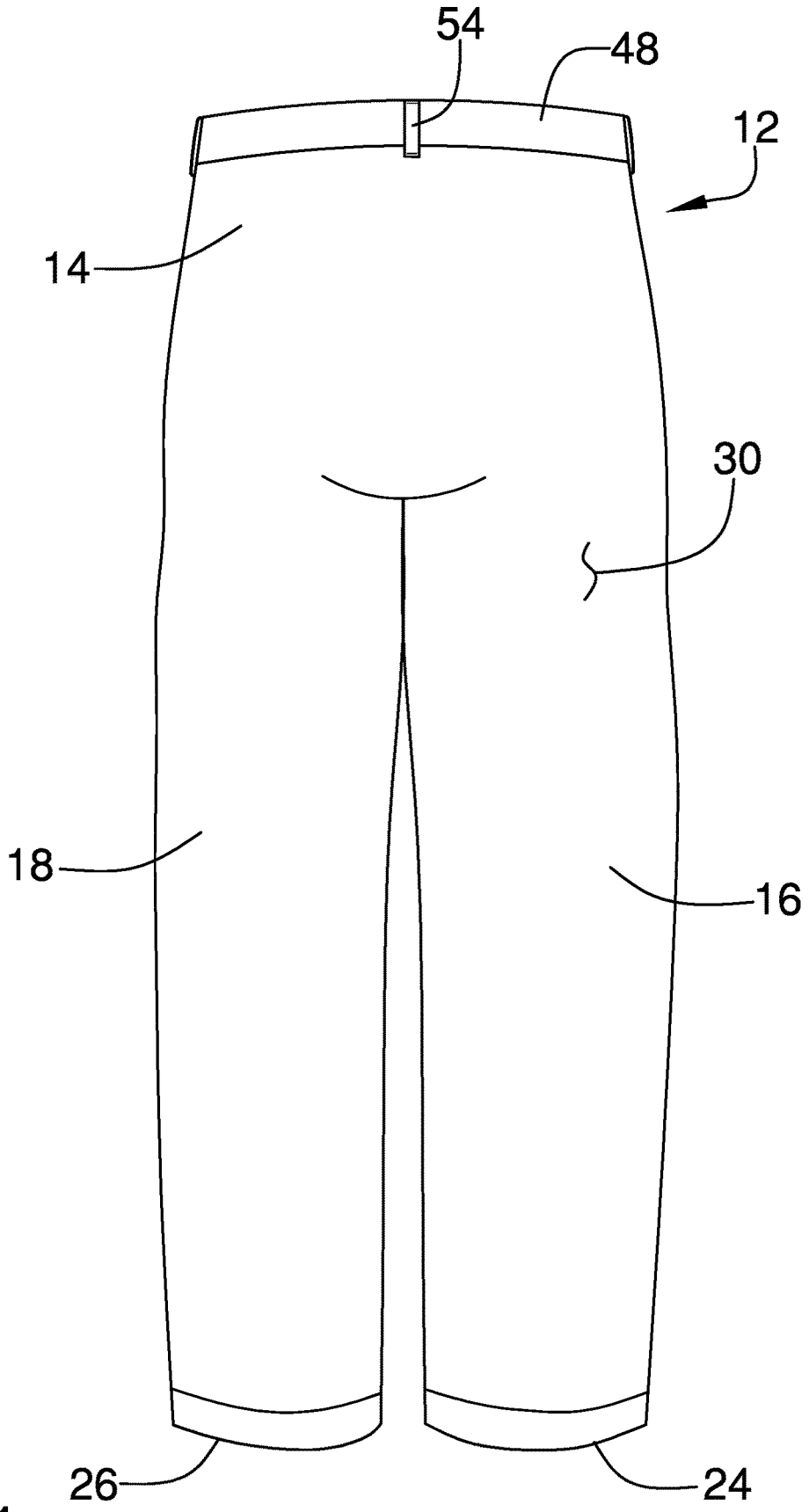
FIG. 4 is a rear view of an embodiment of the disclosure.

The pair of pants 12 may further include a front panel 28 that is configured to be positionable over a front side of the body 20 of the user 22. A back panel 30 is generally coupled to the front panel 28 wherein the back panel 30 is configured to be positionable over a back side of the body 20 of the user 22. The back panel 30 may be smooth wherein the back panel 30 is configured to inhibit skin sores from forming on the back side of the body 20 of the user 22. Skin sores are a common condition for individuals who are permanently or semi-permanently confined to a sitting or laying position. Pockets, seams, and folds can rub against the skin on the back side of such individuals, causing the skin sores to form. The skin sores can often become infected, causing further medical complications. Accordingly, the back panel 30 may not include any pockets, seams, or folds, as shown in FIG. 4.

A pair of outer seams 32 may couple the front panel 28 to the back panel 30. The pair of outer seams 32 may include a first outer seam 34 that extends downwardly from the waist portion 14 along the first leg portion 16. A second outer seam 36 may extend downwardly from the waist portion 14 along the second leg portion 18. The pair of outer seams 32 may also be referred to as a pair of side seams.

A crotch area 38 may be positioned on the waist portion 14. The crotch area 38 generally extends between the first leg portion 16 and the second leg portion 18 wherein the crotch area 38 is spaced from each of the pair of outer seams 32. The crotch area 38 may be positioned between the front panel 28 and the back panel 30. The crotch area 38 is generally configured to cover a crotch of the user 22, between the first leg and the second leg of the user 22.

A fly 40 may extend through the waist portion 14. The fly 40 is generally positioned on the front panel 28. The fly 40 may extend downwardly toward the crotch area 38. The fly 40 is openable wherein the fly 40 is configured to facilitate positioning the pair of pants 12 over the lower portion of the body 20 of the user 22. The fly 40 is also openable to facilitate access to the crotch of the user 22. The fly 40 may have a length between 7.0 inches and 9.0 inches wherein the fly 40 is configured to facilitate access to the crotch of the user 22, for example to facilitate the user 22 in using the bathroom while the user 22 is wearing the pair of pants 12. In another example, the length of the fly 40 may facilitate the user 22 in attending to medical needs, such as a catheter or colostomy bag.

The fly 40 may include a fly closure 148 that is coupled to the front panel 28. The fly closure 148 is positioned adjacent to the fly 40 to selectively open and close the fly 40. In embodiments, the fly closure 148 may comprise a fly zipper 42 that is coupled to the front panel 28. For example, the fly zipper 42 may be a locking zipper that stays in place and does not move until manually manipulated or moved. A fly zipper pull 44 may be coupled to the fly zipper 42. The fly zipper pull 44 is generally slidable along the fly zipper 42 wherein the fly zipper pull 44 is configured to facilitate the user 22 in opening the fly 40.

Figure 6:
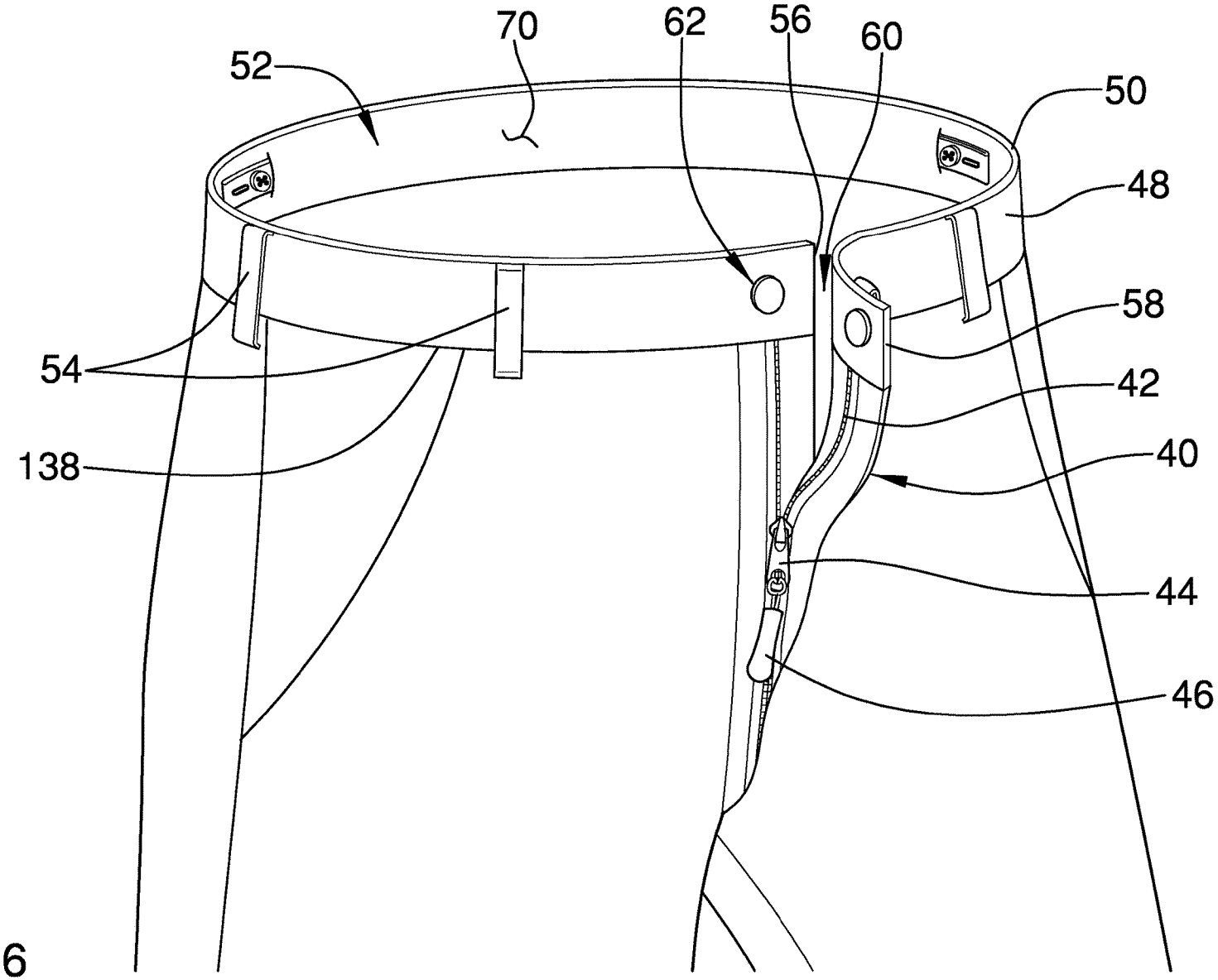
FIG. 6 is a detailed isometric view of an embodiment of the disclosure.

A fly zipper pull tab 46 may be coupled to the fly zipper pull 44. The fly zipper pull tab 46 extends downwardly from the fly zipper pull 44. The fly zipper pull tab 46 may have a surface area exceeding a surface area of the fly zipper pull 44 wherein the fly zipper pull tab 46 is configured to facilitate the user 22 in gripping the fly zipper pull 44 to open and close the fly 40. For example, the fly zipper pull 44 may be elongated, as shown in FIG. 6. Alternatively, the fly zipper pull tab 46 may comprise a loop that is configured to be engageable with a hook 116 to selectively open and close the fly zipper 42, such as the inseam first end pull loop 114 shown in FIG. 9. The fly zipper pull tab 46 is configured to facilitate operation of the fly zipper 42 because the fly zipper pull tab 46 is larger than the fly zipper pull 44. The fly zipper pull tab 46 is thus easier for the user 22 to grasp than the fly zipper pull 44, particularly when the user 22 has a medical condition which reduces mobility and dexterity of their fingers, such as Parkinson's disease and arthritis.

In other embodiments, the fly closure 148 may include alternative designs and materials. For example, cooperating and fastening materials in the shapes of points, bullets, circles, and so forth may be used. A variety of materials such as hook and loop materials, buttons, snaps, laces, hook and eye fasteners, buckles, and magnets may be employed as the fly closure 148.

The pair of pants 12 may comprise a colorfast fabric that can be repeatedly machine washed and dried without damage. The pair of pants 12 may also comprise a fabric with a weave that is resistant or semi-resistant to pet hair, or a fabric that is wrinkle resistant. For example, the pair of pants 12 may be used by someone with mobility issues, or by someone who has difficulty ironing clothing that is not wrinkle resistant. People with physical disabilities or medical concerns also often have pets. For example, the user 22 may have a service animal for assisting with physical or mental conditions. The pet hair resistant weave of the fabric may help the user 22 keep the pair of pants 12 clean.

A waist band 48 may be coupled to the waist portion 14 of the pair of pants 12 distally to the first leg portion 16 and the second leg portion 18. The waist band 48 may have an upper edge 50 that defines an upper opening 52 into the pair of pants 12. The upper opening 52 is generally configured to receive the lower portion of the body 20 of the user 22 to position the pair of pants 12 over the lower portion of the body 20 of the user 22.

The waist band 48 may further include a plurality of belt loops 54. Each belt loop of the plurality of belt loops 54 is generally spaced from an adjacent belt loop of the plurality of belt loops 54. Each belt loop of the plurality of belt loops 54 is generally parallel to an adjacent belt loop of the plurality of belt loops 54. The plurality of belt loops 54 may be positioned on the waist band 48 above each of the front panel 28 and the back panel 30. Each belt loop of the plurality of belt loops 54 may extend downwardly from the upper edge 50 of the waist band 48 past a lower edge 138 of the waist band 48. In embodiments, each belt loop of the plurality of belt loops 54 may extend between 0.125 inches and 0.5 inches below the waist band 48 wherein each belt loop of the plurality of belt loops 54 is coupled to the waist portion 14 of the pair of pants 12. In a preferred embodiment, each belt loop of the plurality of belt loops 54 may extend 0.25 inches past the lower edge 138 of the waist band to accommodate a standardly sized belt being positioned within the plurality of belt loops 54.

A waist band primary end 56 may be positioned adjacent to the fly 40. A waist band secondary end 58 may also be positioned adjacent to the fly 40. The waist band primary end 56 and the waist band secondary end 58 are generally separable to define a waist band break 60 that is aligned with the fly 40. The waist band break 60 is openable wherein the waist band break 60 is configured to facilitate opening the fly 40 and positioning the pair of pants 12 over the lower portion of the body 20 of the user 22.

A fly fastener 62 may releasably couple the waist band primary end 56 to the waist band secondary end 58, to selectively close the waist band break 60. For example, the fly fastener 62 may include a primary fastening piece 64 that is coupled to an exterior surface 66 the waist band 48 adjacent or proximate to the waist band primary end 56. A secondary fastening piece 68 may be releasably couplable to the primary fastening piece 64. The secondary fastening piece 68 is alignable with the primary fastening piece 64. For example, the secondary fastening piece 68 may be coupled to an interior surface 70 of the waist band 48 adjacent or proximate to the waist band secondary end 58.

Each of the primary fastening piece 64 and the secondary fastening piece 68 may comprise a magnet. For example, the magnet of each of the primary fastening piece 64 and the secondary fastening piece 68 may be a rare earth magnet. The rare earth magnet may facilitate each of the primary fastening piece 64 and the secondary fastening piece 68 in withstanding high temperatures, for example during machine washing and drying cycles.

In a preferred embodiment, the magnet of each of the primary fastening piece 64 and the secondary fastening piece 68 is nickel plated wherein the magnet of each of the primary fastening piece 64 and the secondary fastening piece 68 is designed to inhibit rust formation. The nickel plating does not typically result in any significant or appreciable loss of magnetism of the rare earth magnet. For example, if each of the primary fastening piece 64 and the secondary fastening piece 68 are nickel coated rare earth magnets with a diameter of approximately 0.71 inches (or 18.0 millimeters), the fly fastener 62 may have a grasping load of approximately 6.6 pounds, a magnetic flux density of approximately 1300.0 Gauss Units, and may withstand temperatures up to 1060° Fahrenheit without losing durability.

Figure 11:
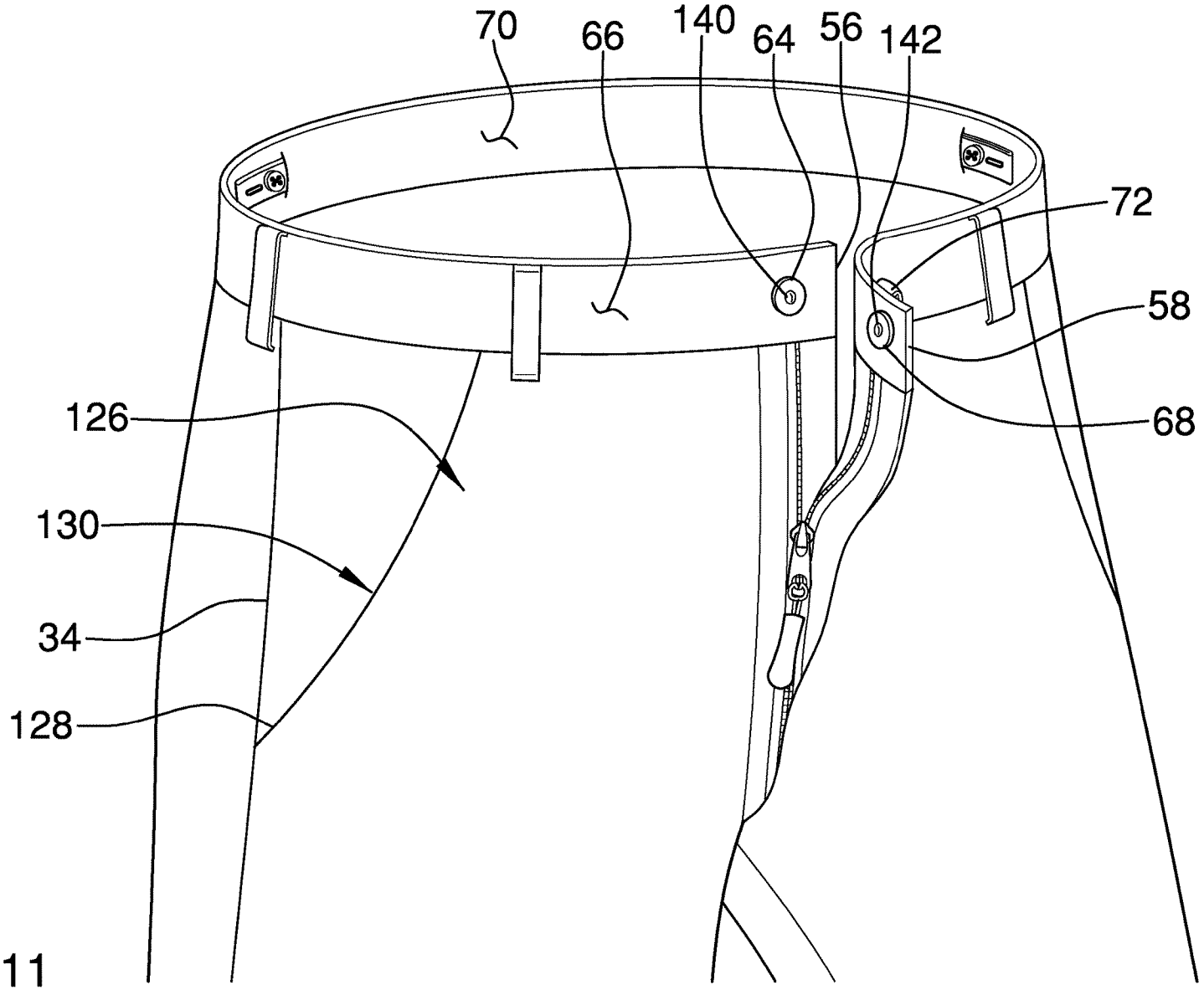
FIG. 11 is a detailed isometric view of an embodiment of the disclosure.

The primary fastening piece 64 may have an indentation 140 that aligns with a detent 142 that protrudes from the secondary fastening piece 68, as shown in FIG. 11. The indentation 140 and detent 142 may facilitate the user in aligning the primary fastening piece 64 with the secondary fastening piece 68 to ensure that the fly fastener 62 is securely engaged. Alternatively, both the primary fastening piece 64 and the secondary fastening piece 68 may be smooth, as shown in FIG. 6. The smooth surfaces of the primary fastening piece 64 and the secondary fastening piece 68 may facilitate the user 22 in manipulating the fly fastener 62, for example when the user 22 lacks fine motor skills.

A control guide loop 72 may be coupled to the waist band 48. The control guide loop 72 may be positioned on the waist band 48 adjacent to the waist band break 60 wherein the control guide loop 72 is configured to facilitate the user 22 in manipulating the fly fastener 62 to selectively open and close the waist band break 60. For example, the user 22 may position a finger within the control guide loop 72 to guide the magnets of the fly fastener 62 together and to pull the magnets of the fly fastener 62 apart. The control guide loop 72 facilitates the user 22 in manipulating the fly fastener 62 when the user 22 has limited finger or hand mobility, or when the user 22 has difficulty with grasping or pinching small objects, such as the snaps or buttons which are traditionally used on pants.

The control guide loop 72 may extend downwardly from the upper edge 50 of the waist band 48 to the lower edge 138 of the waist band 48. The control guide loop 72 may be parallel to each belt loop of the plurality of belt loops 54. The control guide loop 72 is generally spaced from each belt loop of the plurality of belt loops 54. The control guide loop 72 may be positioned on the waist band secondary end 58.

A waist band adjuster 72 may be coupled to the waist band 48. The waist band adjuster 72 is generally configured to facilitate the user 22 in adjusting a diameter of the waist band 48, or a waist size of the pair of pants 12. For example, the waist band adjuster 72 may be designed to facilitate the user 22 in adjusting the diameter of the waist band 48 to accommodate for weight loss, weight gain, or other changes in a size of a waist the user 22.

The waist band adjuster 72 may include a waist band first slit 76 that extends into the interior surface 70 of the waist band 48. For example, the waist band first slit 76 may be positioned proximate to or above the first leg portion 16. A waist band second slit 78 may extend into the interior surface 70 of the waist band 48. For example, the waist band second slit 78 may be positioned proximate to, or above, the second leg portion 18 wherein the waist band second slit 78 is spaced from the waist band first slit 76. As another example, the waist band first slit 76 may be aligned with the first outer seam 34 of the pair of outer seams 32 and the waist band second slit 78 may be aligned with the second outer seam 36 of the pair of outer seams 32. In such embodiments, the waist band adjuster 72 may extend along the length of the entire back panel 30.

An elastic band 80 may be positioned within the waist band 48. The elastic band 80 may be embedded within the waist band 48 between the waist band first slit 76 and the waist band second slit 78. The elastic band 80 generally comprises a resiliently deformable material wherein the elastic band 80 is stretchable to adjust the diameter of the waist band 48. In embodiments, the elastic band 80 may be a length of buttonhole elastic, with apertures aligned along the entire length of the buttonhole elastic, wherein each aperture is equidistantly spaced from an adjacent aperture.

For example, the elastic band 80 may include an elastic band first end 82 that extends outwardly from the waist band first slit 76. A first band fastener 84 may releasably couple the elastic band first end 82 to the waist band 48. The first band fastener 84 is generally configured to secure a position of the elastic band first end 82 relative to the waist band 48. For example, the first band fastener 84 may include a first plurality of band apertures 86 extending through the elastic band 80. The first plurality of band apertures 86 is generally positioned proximate to the elastic band first end 82. Each band aperture of the first plurality of band apertures 86 is generally aligned with the other apertures of the first plurality of band apertures 86 along the elastic band 80. A first band button 88 may be selectively positionable in each aperture of the first plurality of band apertures 86. The first band button 88 may be attached to the interior surface 70 waist band 48 adjacent to the waist band first slit 76.

Figure 5:
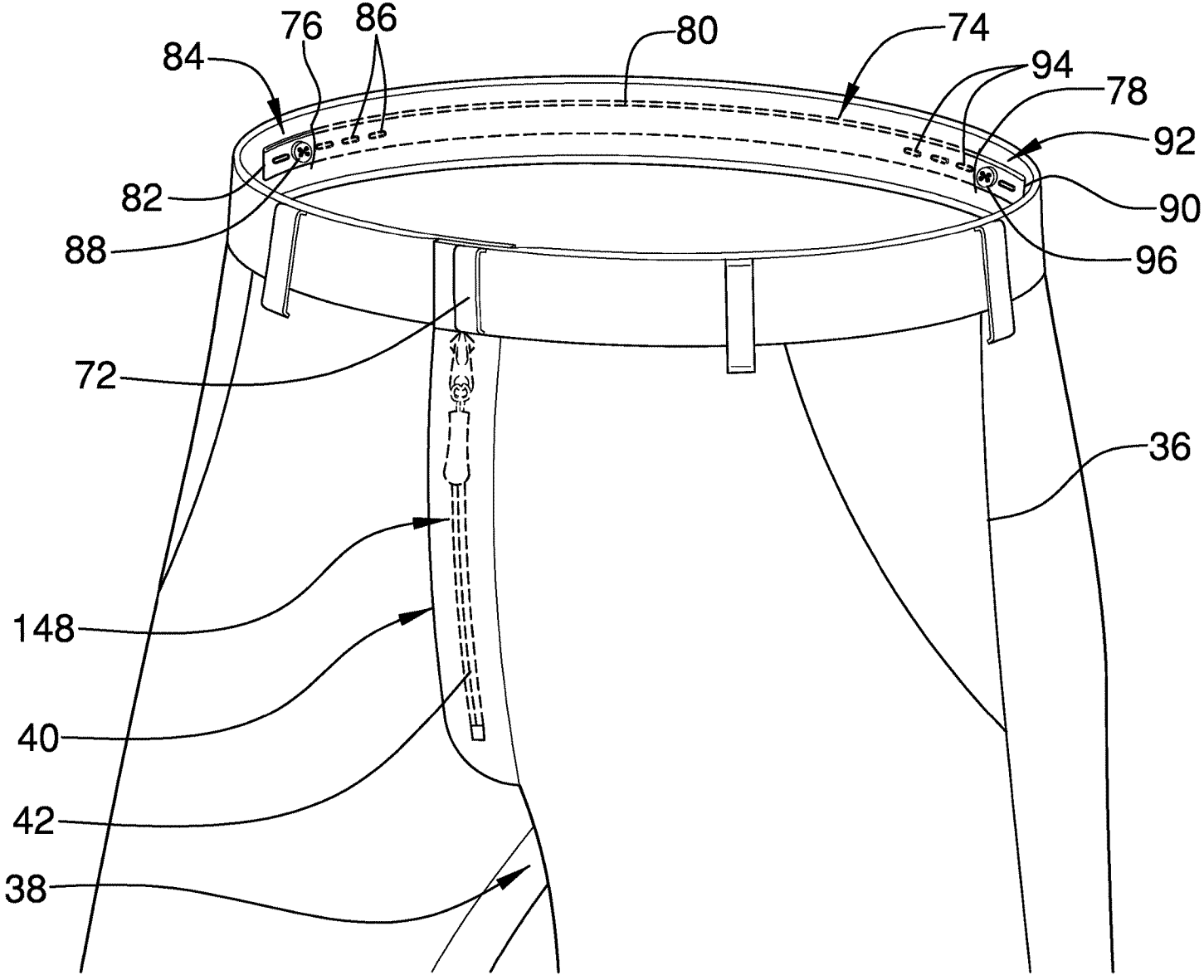
FIG. 5 is a detailed isometric view of an embodiment of the disclosure.

An elastic band second end 90 may extend outwardly from the waist band second slit 78. A second band fastener 92 may releasably couple the elastic band second end 90 to the waist band 48. The second band fastener 92 is generally configured to secure a position of the elastic band second end 90 relative to the waist band 48. For example, the second band fastener 92 may include a second plurality of band apertures 94 extending through the elastic band 80. The second plurality of band apertures 94 is generally positioned proximate to the second elastic band 80. Each band aperture of the second plurality of band apertures 94 is aligned with the other apertures of the second plurality of band apertures 94 along the elastic band 80. The second plurality of band apertures 94 may be spaced from the first plurality of band apertures 86, as shown in FIG. 5. The second plurality of band apertures 94 may be aligned with the first plurality of band apertures 86. A second band button 96 may be selectively positionable in each aperture of the second plurality of band apertures 94. The second band button 96 may be attached to the interior surface 70 of the waist band 48 adjacent to the waist band second slit 78.

An inseam 98 extends across the crotch area 38 and downwardly along each of the first leg portion 16 and the second leg portion 18. The inseam 98 is generally positioned between the front panel 28 and the back panel 30 wherein the inseam 98 couples the front panel 28 to the back panel 30 between the first leg portion 16 and the second leg portion 18. The inseam 98 is spaced from each outer seam of the pair of outer seams 32.

An inseam first end 100 may be positioned above the first leg portion bottom edge 24. The inseam first end 100 may be spaced from the first leg portion bottom edge 24 by between 1.0 inch and 3.0 inches wherein a length of the first leg portion 16 is adjustable. For example, the user 22 may adjust the length of the first leg portion 16 by hemming or altering the first leg portion 16 to move the first leg portion bottom edge 24 upward and closer to the inseam first end 100. In other embodiments, the inseam first end 100 may be positioned on the first leg portion bottom edge 24. In such embodiments, the length of the first leg portion 16 may be more difficult to adjust.

An inseam second end 102 may be positioned above the second leg portion bottom edge 26. The inseam 98 is generally continuous between the inseam first end 100 and the inseam second end 102. The inseam second end 102 may be spaced from the second leg portion bottom edge 26 by between 1.0 inch and 3.0 inches wherein a length of the second leg portion 18 is adjustable. For example, the user 22 may adjust the length of the second leg portion 18 by hemming or altering the second leg portion 18 to move the second leg portion bottom edge 26 upward and closer to the inseam second end 102. In other embodiments, the inseam second end 102 may be positioned on the second leg portion bottom edge 26. In such embodiments, the length of the second leg portion 18 may be more difficult to adjust.

An inseam closure 146 may be coupled to the inseam 98. The inseam closure 146 is generally coextensive with the inseam 98. The inseam closure 146 is openable to define a continuous break 106 along the inseam 98. The continuous break 106 generally extends continuously from the inseam first end 100 to the inseam second end 102 of the inseam 98 wherein the continuous break 106 is configured to selectively expose the first leg, the second leg, and the crotch of the user 22. The inseam closure 146 allows the entire inseam 98 to open, from the inseam first end 100, across the crotch area 38, to the inseam second end 102, providing access to each of the legs and to the crotch of the user 22. The continuous break 106 may facilitate the user 22 in accessing the lower portion of the body 20 of the user 22, for example to change a colostomy bag or access an incontinence aid.

In certain embodiments, the inseam closure 146 includes an inseam zipper 104. In other embodiments, the inseam closure 146 may include alternative designs and materials. For example, cooperating fastening materials in the shapes of points, bullets, circles, and so forth may be used. A variety of materials such as hook and loop materials, buttons, snaps, laces, hook and eye fasteners, buckles, and magnets may be employed as the inseam closure 146.

The inseam zipper 104 may be a coil zipper wherein the inseam zipper 104 is flexible and wherein the inseam zipper 104 is configured to bend with the body 20 of the user 22. For example, the coil zipper may be made of a plastic material that is flexible enough to bend with the contours of the body 20 of the user 22, particularly along the crotch area 38 between the legs of the user 22 and at the knees of the user 22. Using a coil zipper for the inseam zipper 104 thus increases the comfort of pair of pants 12 for the user 22 and minimizes restrictions of movement of the user 22 when the user 22 is wearing the pair of pants 12. The coil zipper of the inseam zipper 104 is also strong enough to withstand multiple uses, including multiple cycles through a washing machine and dryer. When the coil zipper is made of a plastic material, the plastic material may be designed to inhibit rust formation along the inseam zipper 104.

An inseam first end pull 108 may be slidably coupled to the inseam zipper 104 at the inseam first end 100 of the inseam 98. The inseam first end pull 108 may be slidable away from the inseam first end 100 to open the inseam zipper 104. The inseam first end pull 108 may be slidable toward the inseam first end 100 to close the inseam zipper 104.

An inseam second end pull 110 may be slidably coupled to the inseam zipper 104 at the inseam second end 102 of the inseam 98. The inseam second end pull 110 may be slidable away from the inseam second end 102 to open the inseam zipper 104. The inseam second end pull 110 may be slidable toward the inseam second end 102 to close the inseam zipper 104.

Each of the inseam first end pull 108 and the inseam second end pull 110 may be slidable along an entire length of the inseam zipper 104 to completely open the continuous break 106. The continuous break 106 is configured to simultaneously expose each of the first leg, the second leg, and the crotch of the user 22 when the continuous break 106 is completely open. Additionally, the inseam first end pull 108 and the inseam second end pull 110 may slide along the inseam zipper 104 to selectively expose portions of the first leg, the second leg, and the crotch of the user 22 without the user 22 needing to remove the pair of pants 12 or completely expose the lower portion of the body 20.

Figure 7:
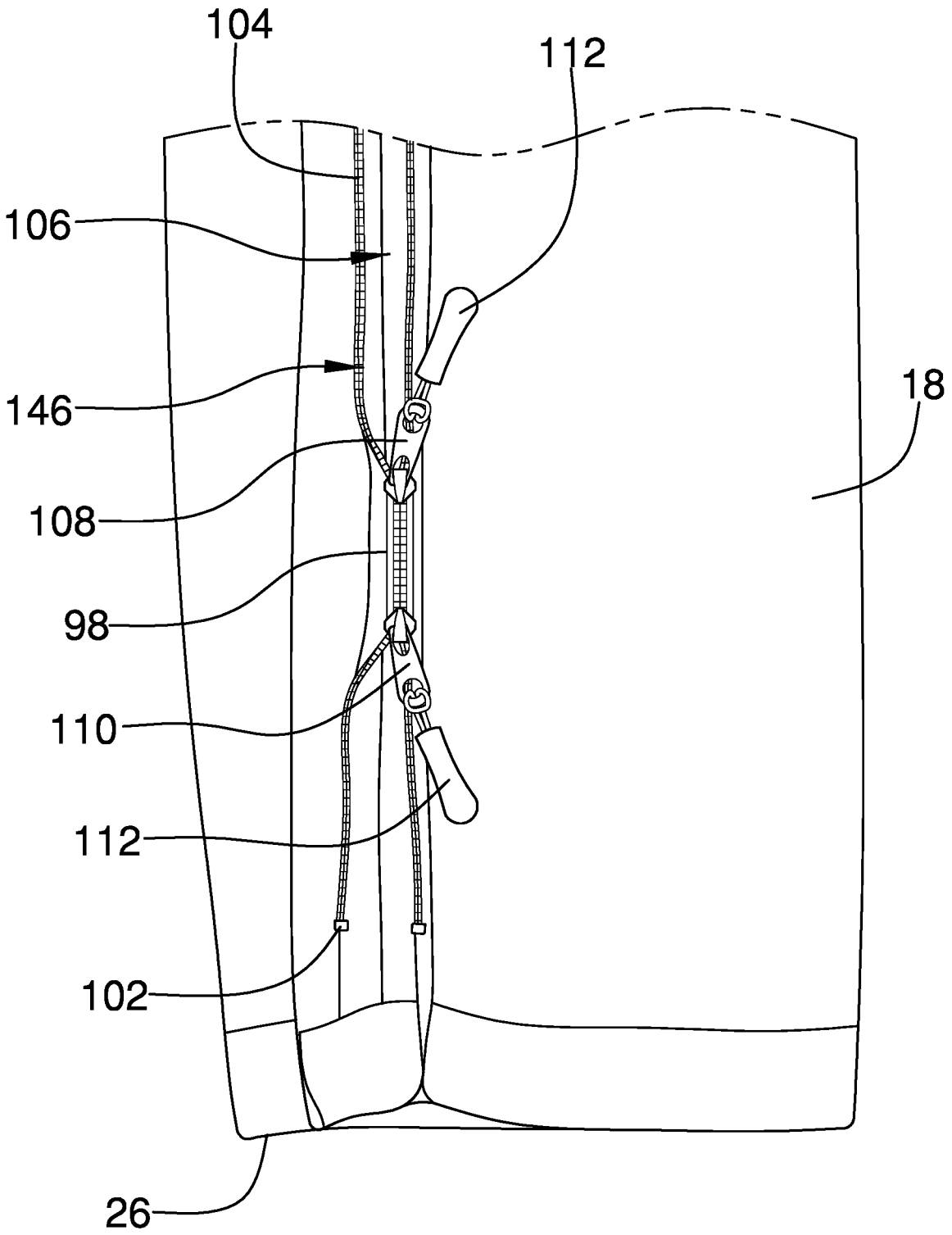
FIG. 7 is a detail view of an embodiment of the disclosure.
Figure 8:
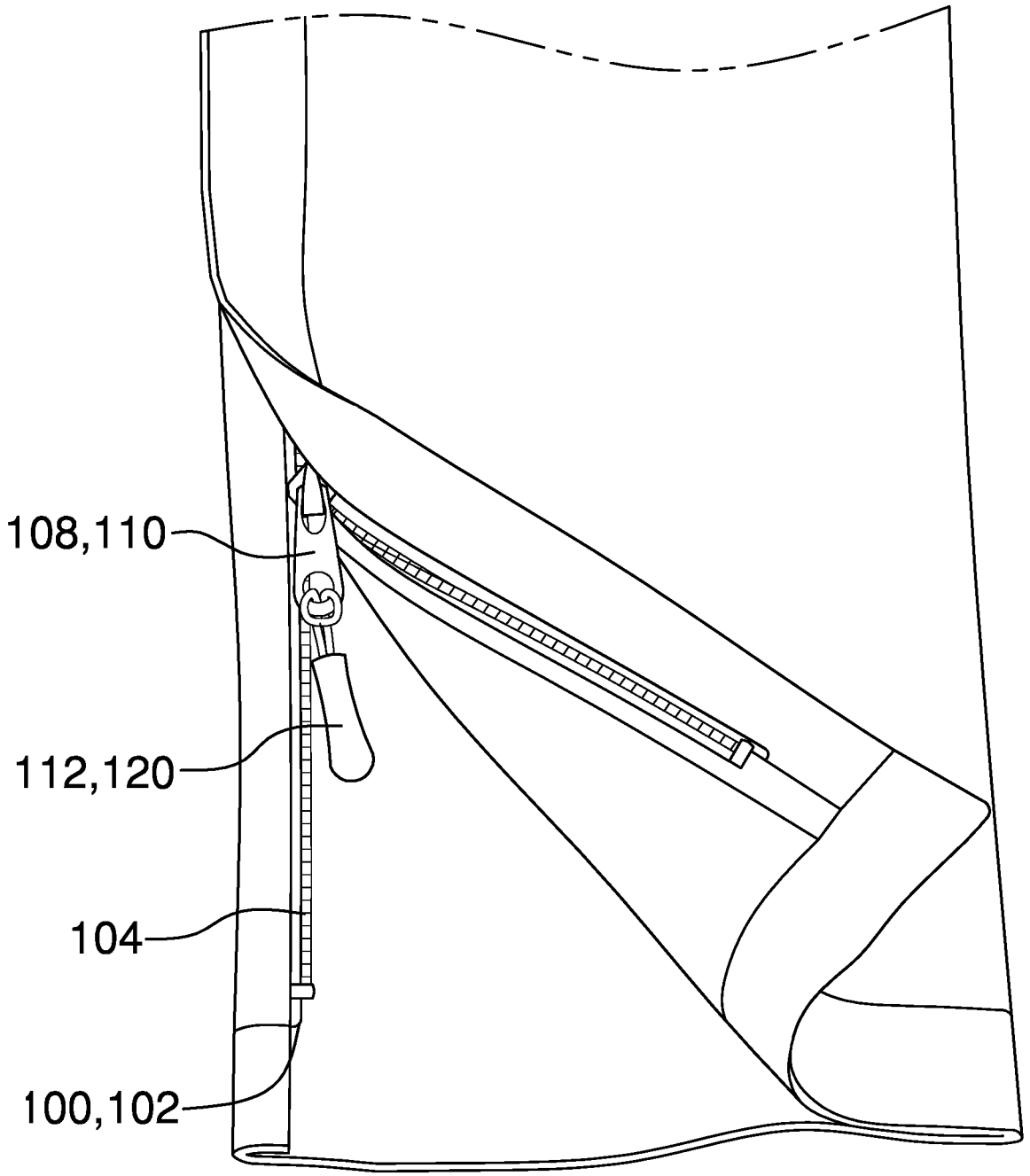
FIG. 8 is a detail view of an embodiment of the disclosure.
Figure 9:
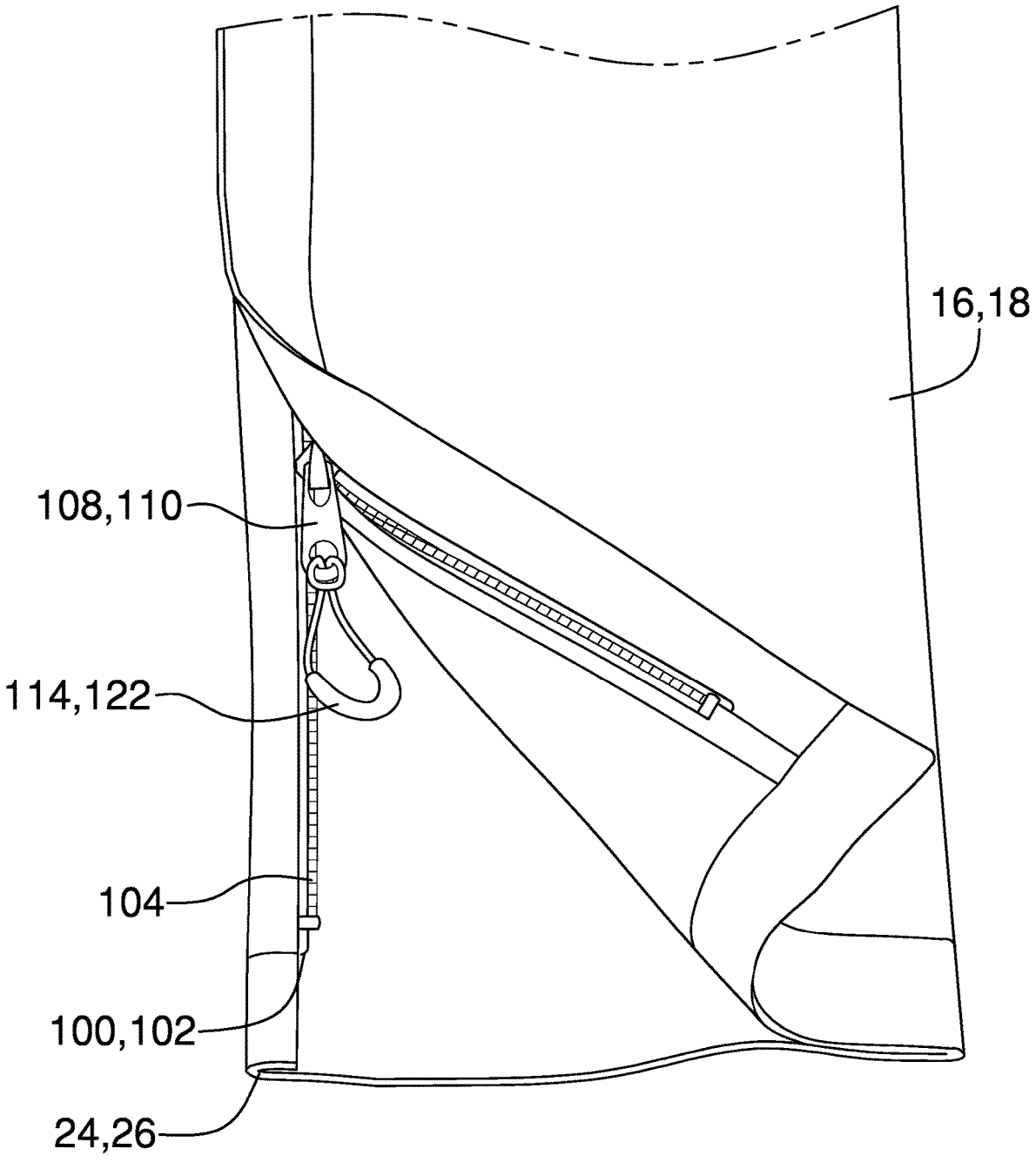
FIG. 9 is a detail view of an embodiment of the disclosure.
Figure 10:
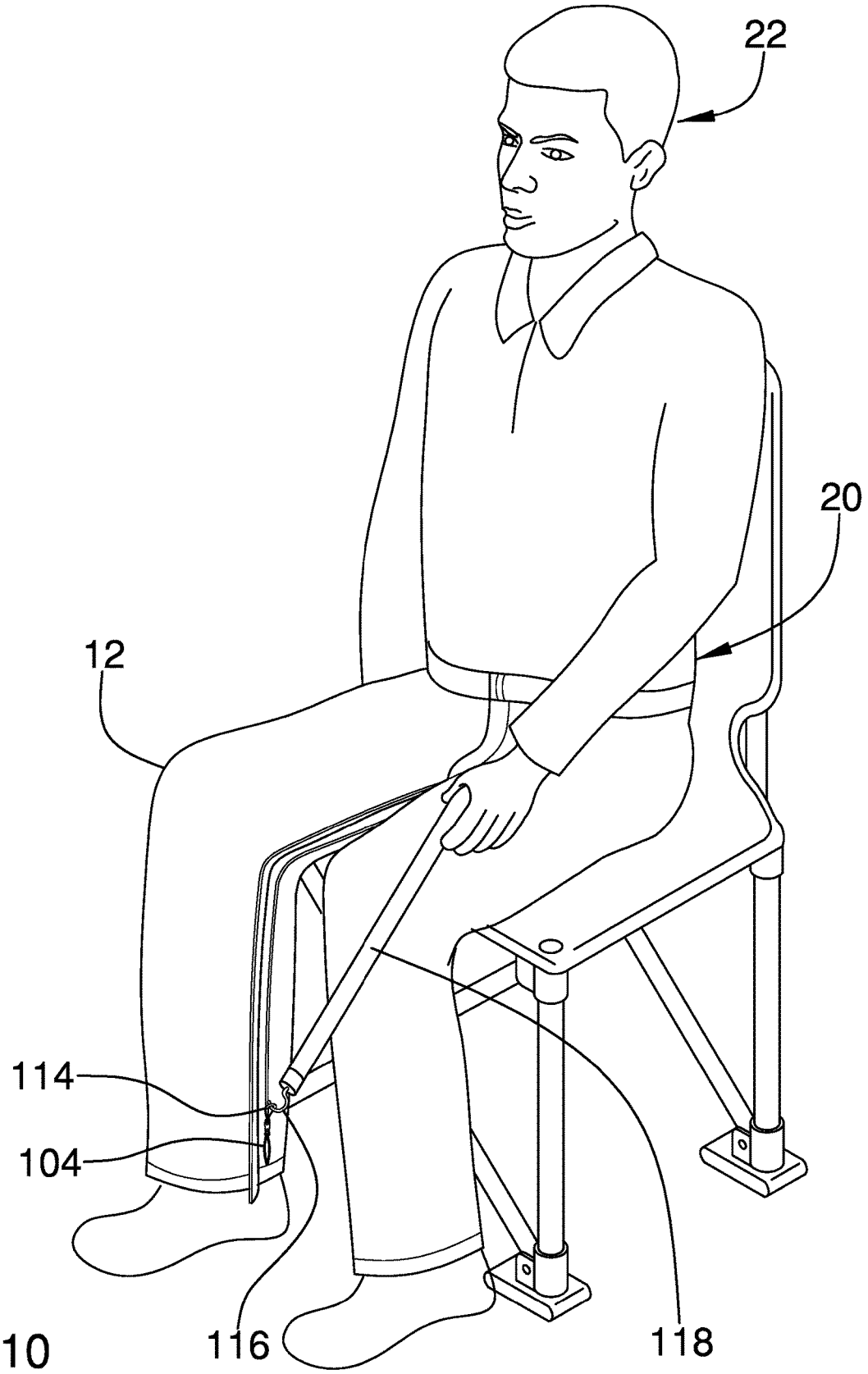
FIG. 10 is an in-use view of an embodiment of the disclosure.

An inseam first end pull tab 112 may be coupled to the inseam first end pull 108. The inseam first end pull tab 112 may extend downwardly from the inseam first end pull 108 wherein the inseam first end pull tab 112 is configured to facilitate the user 22 in gripping the inseam first end pull 108 to open the inseam zipper 104. For example, the inseam first end pull tab 112 may include an inseam first end pull loop 114 that is designed to be engageable with a hook 116 to selectively open the inseam zipper 104. The user 22 may use a stick 118 with the hook 116 attached to one end to grab the inseam first end pull loop 114. For example, when the user 22 has limited torso flexibility, spinal injuries, arthritis or obesity concerns, the user 22 may use the stick 118 and hook 116 to avoid having to bend over to reach the inseam first end pull loop 114. Manipulation of the inseam first end pull loop 114 can urge the inseam first end pull tab 112 along the inseam zipper 104 to open or close the inseam zipper 104. FIGS. 9 and 10 provide an example of the inseam first end pull loop 114 is used to urge the inseam zipper 104 open. Alternatively, the inseam first end pull tab 112 may be elongated, for example as shown in FIGS. 7 and 8.

An inseam second end pull tab 120 may be coupled to the inseam second end pull 110. The inseam second end pull tab 120 may extend downwardly from the inseam second end pull 110 wherein the inseam second end pull tab 120 is configured to facilitate the user 22 in gripping the inseam second end pull 110 to open and close the inseam zipper 104. The inseam second end pull tab 120 may include an inseam second end pull loop 122 that is configured to be engageable with the hook 116 to selectively open the inseam zipper 104. FIGS. 9 and 10 provide an example. Alternatively, the inseam second end pull tab 120 may be elongated, for example as shown in FIGS. 7 and 8.

An inseam flap 124 may be coupled to the pair of pants 12. The inseam flap 124 is generally pivotably coupled to the pair of pants 12. For example, the inseam flap 124 may be selectively positionable over the inseam zipper 104 to cover the inseam zipper 104. The inseam flap 124 may also be selectively pivotable away from the inseam zipper 104 to expose the inseam zipper 104. For example, the inseam flap 124 may be coupled to the front panel 28 of the pair of pants 12 wherein the inseam flap 124 is configured to cover the inseam zipper 104 when the user 22 is walking or moving forward. The inseam flap 124 generally has a width and a weight wherein the inseam flap 124 is configured remain positioned over the inseam zipper 104 until the user 22 manually pivots the inseam flap 124 away from the inseam zipper 104.

A front pocket 126 may be coupled to the pair of pants 12. The front pocket 126 may be positioned on the waist portion 14 and may extend downwardly to one of the first leg portion 16 and the second leg portion 18.

The front pocket 126 may include a front pocket top edge 128 that is coupled to the waist band 48. The front pocket top edge 128 may be angled, for example extending downwardly from the waist band 48 and away from the inseam 98. For example, the front pocket top edge 128 may extend downwardly from the waist band 48 to a respective outer seam of the pair of outer seams 32. In other words, the front pocket 126 may be positioned on the first leg portion 16, and the front pocket top edge 128 may extend to the first outer seam 34 of the pair of outer seams 32. The front pocket top edge 128 defines a front pocket opening 130 into the front pocket 126. The front pocket top edge 128 may be angled wherein the front pocket top edge 128 is designed to inhibit personal items that the user 22 is storing in the front pocket 126 from falling out of the front pocket opening 130. The front pocket top edge 128 may also be angled wherein the front pocket top edge 128 is configured to facilitate the user 22 in accessing the interior of the front pocket 126 through the front pocket opening 130 when the user 22 is seated.

A front pocket bottom edge 132 is generally spaced from the front pocket top edge 128. The front pocket bottom edge 132 may be positioned beneath the fly 40 wherein the front pocket 126 has a length exceeding a length of the fly 40.

Figure 3:
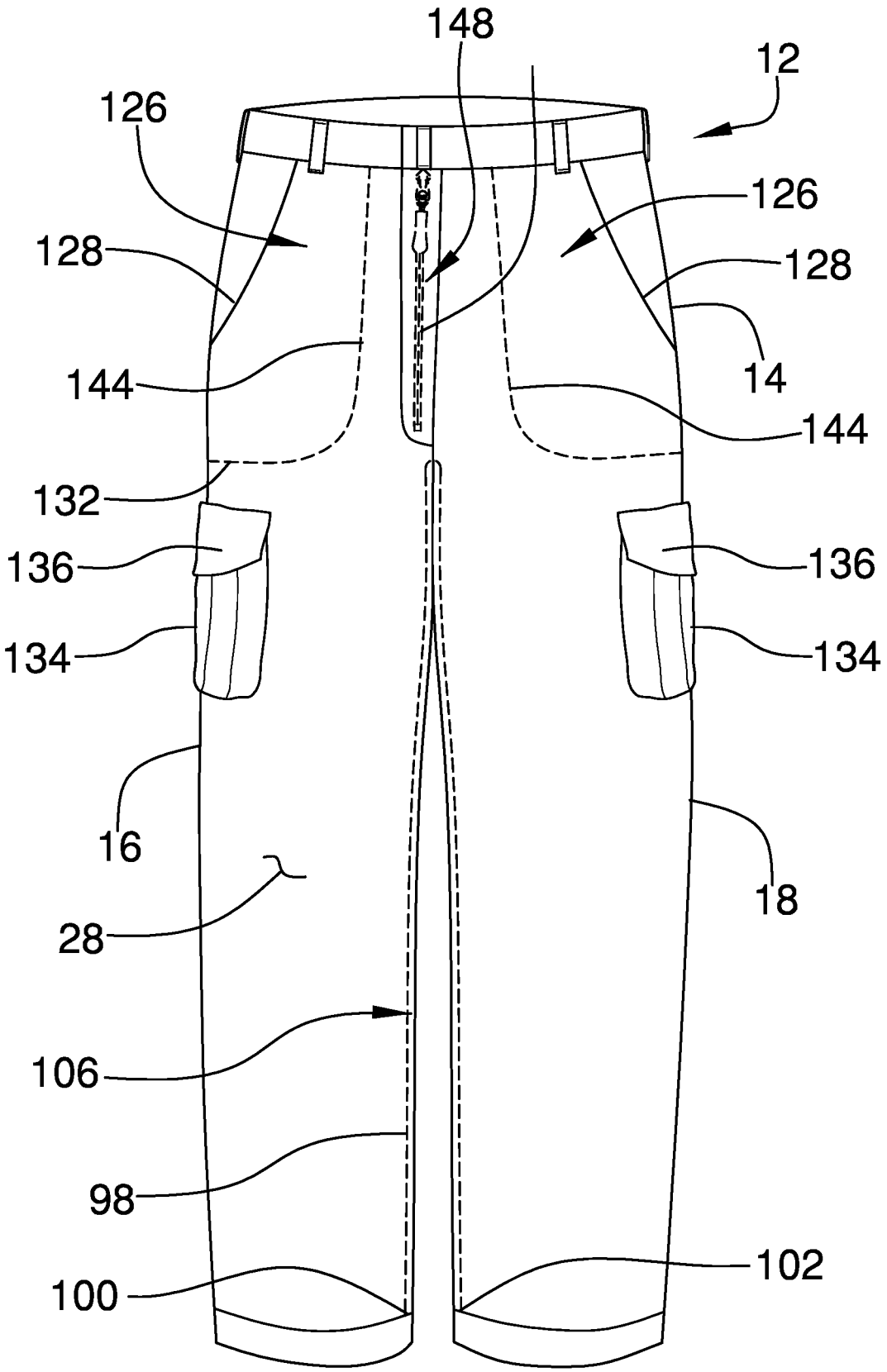
FIG. 3 is a front view of an embodiment of the disclosure.

A front pocket side edge 144 may be coupled to and extend upwardly from the front pocket bottom edge 132, for example to the lower edge 138 of the waist band 48 as shown in FIG. 3. The front pocket side edge 144 may be positioned adjacent to the fly 40 to provide a substantial volume within the interior of the front pocket 126. The front pocket 126 may be curved between the front pocket side edge 144 and the front pocket bottom edge 132. For example, the front pocket 126 may be convexly arcuate between the front pocket side edge 144 and the front pocket bottom edge 132.

Other embodiments may include a pair of front pockets 126 coupled to the pair of pants 12. Each front pocket of the pair of front pockets 126 generally is positioned on the waist portion 14 and extend downwardly to a respective one of the first leg portion 16 and the second leg portion 18.

A plurality of cargo pockets 134 may be coupled to the pair of pants 12. Each cargo pocket of the plurality of cargo pockets 134 is generally positioned on the front panel 28. Each cargo pocket of the plurality of cargo pockets 134 is generally positioned on a respective one of the first leg portion 16 and the second leg portion 18, for example beneath the pair of front pockets 126. Each cargo pocket of the plurality of cargo pockets 134 may be pleated wherein a volume of each cargo pocket of the plurality of cargo pockets 134 is expandable.

Each cargo pocket of the plurality of cargo pockets 134 may include a cargo pocket flap 136 that is coupled to the pair of pants 12. The cargo pocket flap 136 is generally pivotably coupled to the pair of pants 12 above a respective cargo pocket of the plurality of cargo pockets 134. The cargo pocket flap 136 is selectively pivotable downwardly toward the pair of pants 12 to close the respective cargo pocket of the plurality of cargo pockets 134.

In use, the pair of pants 12 will aesthetically resemble a normal pair of slacks, jeans, shorts, or other pants such that an observer would not be able to readily tell that the pair of pants 12 include adaptive clothing features, such as the waist band adjuster 72 or the inseam 98 that opens completely. In certain embodiments, the pair of pants 12 may be specifically designed for men. In such embodiments, the pair of pants 12 provides the user 22 with comfort and flexibility, facilitates the user 22 in dressing and undressing themselves, and facilitates the user 22 in accessing or changing incontinence aids. The pair of pants 12 also facilitates a caretaker of the user 22 in dressing and undressing the user and facilitates the caretaker of the user 22 in accessing or changing incontinence aids of the user 22. For example, the user 22 may open the inseam zipper 104 from one of the inseam first end 100 and the inseam second end 102 to access a urostomy pouch, a catheter, or a colostomy bag.

In other examples, the user 22 may open the inseam zipper 104 to access a prosthesis, bandaging, other medical condition which may require attention. Opening the inseam zipper 104 can also provide access to the lower portion of the body 20 of the user during examinations, so that the user 22 does not need to remove the pair of pants 12. For example, removing the pair of pants 12 often requires a harness, which may be used in conjunction with a mechanical lift, for lifting the user 22 as a caretaker or medical professional removes the pair of pants 12. The continuous break 106 facilitates quick and easy access to the lower portion of the body 20 of the user 22 without requiring removal of the pair of pants 12. The continuous break 106 of the inseam 98 allows 180° access to each leg and the crotch of the user 22 without removing the pair of pants 12. Each side of the inseam 98 can also be opened to provide selective access to one of the legs.

This disclosure contemplates a choice of styles for each of the inseam first end pull tab 112 and the inseam second end pull tab 120. The choice may be made based on the dexterity or other needs of the user 22. For example, if the user 22 has lost fine motor skills and cannot grip the inseam first end pull tab 112, the inseam first end pull loop 114 may facilitate the user 22 in sliding the inseam first end pull 108 along the inseam zipper 104 to open and close the inseam zipper 104.

The fly fastener 62 is magnetic, so that the fly fastener 62 can be easily manipulated by the user 22 when the user 22 has a loss of fine motor skills or has other physical impairments which make manipulation of buttons and snaps difficult or impossible. For example, if the user 22 has Parkinson's Disease or another physical disability that affects fine motor skills, buttons and snaps can be difficult, or impossible, for the user 22 to manipulate themselves. Magnetic closures thus allow the user 22 to dress themselves, providing the user 22 with independence and dignity.

Additionally, the fly zipper pull tab 46 attached to the fly zipper pull 44 is designed to facilitate the user 22 in manipulating the fly zipper 42 because the fly zipper pull tab 46 is easier for the user 22 to grip and manipulate than the fly zipper pull 44 that is traditionally used to open and close the fly zipper 42. The fly zipper pull tab 46 may be concealed in the flap of the fly 40 or tucked in at the waist band 48 before closing the fly fastener 62, so that the fly zipper pull tab 46 is not readily apparent to others while the user 22 is wearing the pair of pants 12. The fly zipper 42 is also longer than a traditional fly zipper 42, making the pair of pants 12 easier for the user 22 to dress or undress, and facilitating the user 22 in opening the fly 40 to use the bathroom without the pair of pants 12 getting in the way. The fly zipper 42 may be a locking zipper to inhibit the fly zipper 42 from opening without manipulation by the user 22.

The waist band adjuster 72 facilitates the user 22 in changing the size of the pair of pants 12, for example to accommodate swelling or weight changes of the user 22. The waist band adjuster 72 increases the lifetime of the pair of pants 12, because the user 22 can make adjustments to the size of the waist of the pair of pants 12 without needing to purchase additional pairs for weight fluctuations that can accompany various medical conditions. The position of each of the elastic band first end 82 and the elastic band second end 90 may be independently adjusted to facilitate equal distribution of the fabric of the waist band 48 and to allow the entire back of the waist band 48 to be affected by the waist band adjuster 72.

The waist band 48 may comprise a reinforced material, or the waist band 48 may be reinforced, particularly at the waist band primary end 56 and the waist band secondary end 58, around the fly fastener 62. For example, the waist band 48 may include an interfacing to stabilize the material of the waist band 48 to prevent tearing. The reinforced waist band 48 gives strength for repeated use of the fly fastener 62. Each belt loop of the plurality of belt loops 54 may also be reinforced on the waist band 48 to inhibit the plurality of belt loops 54 from detaching from the waist band 48. For example, each belt loop of the plurality of belt loops 54 may be triple stitched to the waist band 48. The reinforcements of each belt loop of the plurality of belt loops 54 increases the lifetime and durability of the pair of pants 12, even after repeated use of pulling up the pair of pants 12 by the plurality of belt loops 54. In certain embodiments, the waist band 48 and the plurality of belt loops 54 may be reinforced to facilitate the caretaker of the user 22 in moving or transferring the user 22, for example between a bed and a chair, by pulling or gripping the plurality of belt loops 54 and the waist band 48.

Folds and seams along the back of pants can cause body 20 sores to form on a user 22 who is confined to sitting permanently or for long periods of time. The body 20 sores can lead to infection. Accordingly, the back panel 30 of the pair of pants 12 may be smooth, without any back pockets or other folds or seams along the back panel 30. FIG. 4 provides an example.

The front pocket 126, or the pair of front pockets 126, are deeper than a standard front pocket 126. The added depth of the front pocket 126 provides easy access and storage to the user 22 for the personal belongings of the user 22, such as a cell phone or wallet. Some embodiments may also optionally include the plurality of cargo pockets 134 for increased storage of the personal belongings. Each front pocket 126 and cargo pocket is positioned on the front panel 28 to avoid body 20 sores forming on the back of the user 22, as described above.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adaptive apparel assembly comprising:

a pair of pants having a waist portion being coupled to a first leg portion and a second leg portion, the first leg portion and the second leg portion extending downwardly from the waist portion wherein the first leg portion is configured to receive a first leg of a user and wherein the second leg portion is configured to receive a second leg of the user, the first leg portion having a first leg portion bottom edge being distal to the waist portion, the second leg portion having a second leg portion bottom edge being distal to the waist portion, the pair of pants including:

a crotch area being positioned on the waist portion, the crotch area extending between the first leg portion and the second leg portion;

a waist band being coupled to the waist portion of the pair of pants distally to the first leg portion and the second leg portion;

a waist band adjuster being coupled to the waist band wherein the waist band adjuster is configured to facilitate the user in adjusting a diameter of the waist band, the waist band adjuster including:

a waist band first slit extending into an interior surface of the waist band proximate to the first leg portion;

a waist band second slit extending into an interior surface of the waist band proximate to the second leg portion wherein the waist band second slit is spaced from the waist band first slit; and an elastic band being positioned within the waist band, the elastic band being embedded within the waist band between the waist band first slit and the waist band second slit, the elastic band comprising a resiliently deformable material wherein the elastic band is stretchable to adjust the diameter of the waist band, the elastic band including:

an elastic band first end extending outwardly from the waist band first slit;

a first band fastener releasably coupling the elastic band first end to the waist band wherein the first band fastener is configured to secure a position of the elastic band first end relative to the waist band;

an elastic band second end being extending outwardly from the waist band second slit; and a second band fastener releasably coupling the elastic band second end to the waist band wherein the second band fastener is configured to secure a position of the elastic band second end relative to the waist band; and an inseam extending across the crotch area and downwardly along each of the first leg portion and the second leg portion, the inseam including:

an inseam first end being positioned above the first leg portion bottom edge;

an inseam second end being positioned above the second leg portion bottom edge, the inseam being continuous between the inseam first end and the inseam second end; and an inseam closure being coextensive with the inseam, the inseam closure being openable to define a continuous break along the inseam, the continuous break extending continuously from the inseam first end to the inseam second end wherein the continuous break is configured to selectively expose the first leg, the second leg, and a crotch of the user.

2. The adaptive apparel assembly of claim 1, wherein the inseam first end is spaced from the first leg portion bottom edge, and wherein the inseam second end is spaced from the second leg portion bottom edge.

3. The adaptive apparel assembly of claim 1, the inseam closure further including:

an inseam zipper;

an inseam first end pull being slidably coupled to the inseam zipper at the inseam first end, the inseam first end pull being slidable away from the inseam first end to open the inseam zipper;

an inseam second end pull being slidably coupled to the inseam zipper at the inseam second end, the inseam second end pull being slidable away from the inseam second end to open the inseam zipper; and each of the inseam first end pull and the inseam second end pull being slidable along an entire length of the inseam zipper wherein the continuous break is configured to simultaneously expose each of the first leg, the second leg, and the crotch of the user when the continuous break is completely open.

4. The adaptive apparel assembly of claim 3, wherein the inseam zipper is a coil zipper wherein the inseam zipper is flexible whereby the inseam zipper is configured to bend with a body of the user.

5. The adaptive apparel assembly of claim 3, the inseam zipper further comprising an inseam first end pull tab being coupled to the inseam first end pull, the inseam first end pull tab extending downwardly from the inseam first end pull wherein the inseam first end pull tab is configured to facilitate the user in gripping the inseam first end pull to open the inseam zipper.

6. The adaptive apparel assembly of claim 5, the inseam first end pull tab further comprising an inseam first end pull loop being configured to be engageable with a hook to selectively open the inseam zipper.

7. The adaptive apparel assembly of claim 5, wherein the inseam first end pull tab is elongated.

8. The adaptive apparel assembly of claim 3, the inseam zipper further comprising an inseam second end pull tab being coupled to the inseam second end pull, the inseam second end pull tab extending downwardly from the inseam second end pull wherein the inseam second end pull tab is configured to facilitate the user in gripping the inseam second end pull to open the inseam zipper.

9. The adaptive apparel assembly of claim 8, the inseam second end pull tab further comprising an inseam second end pull loop being configured to be engageable with a hook to selectively open the inseam zipper.

10. The adaptive apparel assembly of claim 8, wherein the inseam second end pull tab is elongated.

11. The adaptive apparel assembly of claim 1, further comprising an inseam flap being coupled to the pair of pants, the inseam flap being pivotably coupled to the pair of pants wherein the inseam flap is selectively positionable over the inseam closure to cover the inseam closure.

12. The adaptive apparel assembly of claim 1, the pair of pants further comprising:

a front panel being configured to be positionable over a front side of a body of the user;

a back panel being coupled to the front panel wherein the back panel is configured to be positionable over a back side of the body of the user;

a pair of outer seams coupling the front panel to the back panel, the pair of outer seams including:

a first outer seam extending downwardly from the waist portion along the first leg portion;

a second outer seam extending downwardly from the waist portion along the second leg portion; and the crotch area being spaced from each of the pair of outer seams, the crotch area being positioned between the front panel and the back panel.

13. The adaptive apparel assembly of claim 12, the pair of pants further comprising:

a fly extending through the waist portion, the fly being positioned on the front panel, the fly extending downwardly toward the crotch area, the fly being openable wherein the fly is configured to facilitate positioning the pair of pants over the body of the user; and a fly closure being coupled to the front panel of the pair of pants, the fly closure being positioned adjacent to the fly to selectively open and close the fly.

14. The adaptive apparel assembly of claim 13, wherein the fly has a length between 7.0 inches and 9.0 inches.

15. The adaptive apparel assembly of claim 13, the fly closure further comprising:

a fly zipper being coupled to the front panel;

a fly zipper pull being coupled to the fly zipper, the fly zipper pull being slidable along the fly zipper wherein the fly zipper pull is configured to facilitate the user in opening the fly; and a fly zipper pull tab being coupled to the fly zipper pull, the fly zipper pull tab extending downwardly from the fly zipper pull, the fly zipper pull tab having a surface area exceeding a surface area of the fly zipper pull wherein the fly zipper pull tab is configured to facilitate the user in gripping the fly zipper pull to open the fly.

16. The adaptive apparel assembly of claim 14, further comprising:

a waist band being coupled to the waist portion of the pair of pants distally to the first leg portion and the second leg portion, the waist band having an upper edge defining an upper opening into the pair of pants wherein the upper opening is configured to receive the body of the user to position the pair of pants over the body of the user, the waist band including:

a waist band primary end being positioned adjacent to the fly;

a waist band secondary end being positioned adjacent to the fly wherein the waist band primary end and the waist band secondary end are separable to define a waist band break being aligned with the fly, the waist band break being openable wherein the waist band break is configured to facilitate opening the fly and positioning the pair of pants over the body of the user;

a fly fastener releasably coupling the waist band primary end to the waist band secondary end, the fly fastener including:

a primary fastening piece being coupled to an exterior surface the waist band adjacent to the waist band primary end; and a secondary fastening piece being releasably couplable to the primary fastening piece, the secondary fastening piece being alignable with the primary fastening piece, the secondary fastening piece being coupled to an interior surface of the waist band adjacent to the waist band secondary end.

17. The adaptive apparel assembly of claim 16, wherein each of the primary fastening piece and the secondary fastening piece comprise a magnet.

18. The adaptive apparel assembly of claim 1, further comprising:

a front pocket being coupled to the pair of pants, the front pocket being positioned on the waist portion and extending downwardly to one of the first leg portion and the second leg portion, the front pocket including:

a front pocket top edge being coupled to the waist band, the front pocket top edge being angled extending downwardly from the waist band and away from the inseam, the front pocket top edge defining a front pocket opening into the front pocket; and a front pocket bottom edge being spaced from the front pocket top edge.

19. An adaptive apparel assembly comprising:

a pair of pants having a waist portion being coupled to a first leg portion and a second leg portion wherein the pair of pants is configured to be positionable over a lower portion of a body of a user, the first leg portion and the second leg portion extending downwardly from the waist portion wherein the first leg portion is configured to receive a first leg of the user and wherein the second leg portion is configured to receive a second leg of the user, the first leg portion having a first leg portion bottom edge being distal to the waist portion, the second leg portion having a second leg portion bottom edge being distal to the waist portion, the first leg portion bottom edge being aligned with the second leg portion bottom edge wherein a length of the first leg portion is equal to a length of the second leg portion, the pair of pants further including:

a front panel being configured to be positionable over a front side of the body of the user;

a back panel being coupled to the front panel wherein the back panel is configured to be positionable over a back side of the body of the user, the back panel being smooth wherein the back panel is configured to inhibit skin sores from forming on the back side of the body of the user;

a pair of outer seams coupling the front panel to the back panel, the pair of outer seams including:

a first outer seam extending downwardly from the waist portion along the first leg portion;

a second outer seam extending downwardly from the waist portion along the second leg portion;

a crotch area being positioned on the waist portion, the crotch area extending between the first leg portion and the second leg portion wherein the crotch area is spaced from the pair of outer seams, the crotch area being positioned between the front panel and the back panel;

a fly extending through the waist portion, the fly being positioned on the front panel, the fly extending downwardly toward the crotch area, the fly being openable wherein the fly is configured to facilitate positioning the pair of pants over the lower portion of the body of the user, the fly having a length between 7.0 inches and 9.0 inches;

a fly closure being coupled to the front panel of the pair of pants, the fly closure being positioned adjacent to the fly to selectively open and close the fly, the fly closure including:

a fly zipper being coupled to the front panel;

a fly zipper pull being coupled to the fly zipper, the fly zipper pull being slidable along the fly zipper wherein the fly zipper pull is configured to facilitate the user in opening the fly;

a fly zipper pull tab being coupled to the fly zipper pull, the fly zipper pull tab extending downwardly from the fly zipper pull, the fly zipper pull tab having a surface area exceeding a surface area of the fly zipper pull wherein the fly zipper pull tab is configured to facilitate the user in gripping the fly zipper pull to open the fly, the fly zipper pull being elongated;

a waist band being coupled to the waist portion of the pair of pants distally to the first leg portion and the second leg portion, the waist band having an upper edge defining an upper opening into the pair of pants wherein the upper opening is configured to receive the lower portion of the body of the user to position the pair of pants over the lower portion of the body of the user, the waist band further including:

a plurality of belt loops, each belt loop of the plurality of belt loops being spaced from an adjacent belt loop of the plurality of belt loops wherein the plurality of belt loops is positioned on each of the front panel and the back panel, each belt loop of the plurality of belt loops extending downwardly from the upper edge of the waist band, each belt loop of the plurality of belt loops being parallel to an adjacent belt loop of the plurality of belt loops;

a waist band primary end being positioned adjacent to the fly;

a waist band secondary end being positioned adjacent to the fly wherein the waist band primary end and the waist band secondary end are separable to define a waist band break being aligned with the fly, the waist band break being openable wherein the waist band break is configured to facilitate opening the fly and positioning the pair of pants over the lower portion of the body of the user;

a fly fastener releasably coupling the waist band primary end to the waist band secondary end, the fly fastener including:

a primary fastening piece being coupled to an exterior surface the waist band proximate to the waist band primary end;

a secondary fastening piece being releasably couplable to the primary fastening piece, the secondary fastening piece being alignable with the primary fastening piece, the secondary fastening piece being coupled to an interior surface of the waist band proximate to the waist band secondary end;

wherein each of the primary fastening piece and the secondary fastening piece comprise a magnet, the magnet being a rare earth magnet, the magnet being nickel plated wherein the magnet is configured to inhibit rust formation;

a control guide loop being coupled to the waist band, the control guide loop being positioned adjacent to the waist band break wherein the control guide loop is configured to facilitate the user in manipulating the fly fastener to selectively open and close the waist band break, the control guide loop extending downwardly from the upper edge of the waist band, the control guide loop being parallel to the plurality of belt loops, the control guide loop being spaced from each belt loop of the plurality of belt loops, the control guide loop being positioned on the waist band secondary end;

a waist band adjuster being coupled to the waist band wherein the waist band adjuster is configured to facilitate the user in adjusting a diameter of the waist band, the waist band adjuster including:

a waist band first slit extending into the interior surface of the waist band proximate to the first leg portion;

a waist band second slit extending into the interior surface of the waist band proximate to the second leg portion wherein the waist band second slit is spaced from the waist band first slit;

an elastic band being positioned within the waist band, the elastic band being embedded within the waist band between the waist band first slit and the waist band second slit, the elastic band comprising a resiliently deformable material wherein the elastic band is stretchable to adjust the diameter of the waist band, the elastic band including:

an elastic band first end extending outwardly from the waist band first slit;

a first band fastener releasably coupling the elastic band first end to the waist band wherein the first band fastener is configured to secure a position of the elastic band first end relative to the waist band, the first band fastener including:

a first plurality of band apertures extending through the elastic band, the first plurality of band apertures being positioned proximate to the elastic band first end, the first plurality of band apertures being aligned with each other along the elastic band;

a first band button being selectively positionable in each aperture of the first plurality of band apertures, the first band button being attached to the waist band adjacent to the waist band first slit;

an elastic band second end being extending outwardly from the waist band second slit;

a second band fastener releasably coupling the elastic band second end to the waist band wherein the second band fastener is configured to secure a position of the elastic band second end relative to the waist band, the second band fastener including:

a second plurality of band apertures extending through the elastic band, the second plurality of band apertures being positioned proximate to the second elastic band, the second plurality of band apertures being aligned with each other along the elastic band, the second plurality of band apertures being spaced from the first plurality of band apertures;

a second band button being selectively positionable in each aperture of the second plurality of band apertures, the second band button being attached to the waist band adjacent to the waist band second slit;

an inseam extending across the crotch area and downwardly along each of the first leg portion and the second leg portion, the inseam being positioned between the front panel and the back panel wherein the inseam couples the front panel to the back panel between the first leg portion and the second leg portion, the inseam being spaced from the pair of outer seams, the inseam including:

an inseam first end being positioned above at the first leg portion bottom edge, the inseam first end being spaced from the first leg portion bottom edge by between 1.0 inch and 3.0 inches wherein a length of the first leg portion is adjustable;

an inseam second end being positioned above the second leg portion bottom edge, the inseam being continuous between the inseam first end and the inseam second end, the inseam second end being spaced from the second leg portion bottom edge by between 1.0 inch and 3.0 inches wherein a length of the second leg portion is adjustable;

an inseam closure being coextensive with the inseam, the inseam closure being openable to define a continuous break along the inseam, the continuous break extending continuously from the inseam first end to the inseam second end of the inseam wherein the continuous break is configured to selectively expose the first leg, the second leg, and a crotch of the user, the inseam zipper further including:

an inseam zipper extending continuously from the inseam first end to the inseam second end, the inseam zipper being a coil zipper wherein the inseam zipper is flexible whereby the inseam zipper is configured to bend with the body of the user;

an inseam first end pull being slidably coupled to the inseam zipper at the inseam first end of the inseam, the inseam first end pull being slidable away from the inseam first end to open the inseam zipper;

an inseam second end pull being slidably coupled to the inseam zipper at the inseam second end of the inseam, the inseam second end pull being slidable away from the inseam second end to open the inseam zipper;

each of the inseam first end pull and the inseam second end pull being slidable along an entire length of the inseam zipper wherein the continuous break is configured to simultaneously expose each of the first leg, the second leg, and the crotch of the user when the continuous break is completely open;

an inseam first end pull tab being coupled to the inseam first end pull, the inseam first end pull tab extending downwardly from the inseam first end pull wherein the inseam first end pull tab is configured to facilitate the user in gripping the inseam first end pull to open the inseam zipper, the inseam first end pull tab including:

an inseam first end pull loop being configured to be engageable with a hook to selectively open the inseam zipper;

an inseam second end pull tab being coupled to the inseam second end pull, the inseam second end pull tab extending downwardly from the inseam second end pull wherein the inseam second end pull tab is configured to facilitate the user in gripping the inseam second end pull to open the inseam zipper, the inseam second end pull tab including:

an inseam second end pull loop being configured to be engageable with the hook to selectively open the inseam zipper;

an inseam flap being coupled to the pair of pants, the inseam flap being pivotably coupled to the pair of pants wherein the inseam flap is selectively positionable over the inseam zipper to cover the inseam zipper and wherein the inseam flap is selectively pivotable away from the inseam zipper to expose the inseam zipper;

a pair front pockets being coupled to the pair of pants, each of the pair of front pockets being positioned on the waist portion and extending downwardly to a respective one of the first leg portion and the second leg portion, each of the pair of front pockets being positioned on the front panel, each front pocket of the pair of front pockets including:

a front pocket top edge being coupled to the waist band, the front pocket top edge being angled extending downwardly from the waist band to a respective outer seam of the pair of outer seams, the front pocket top edge defining a front pocket opening into each front pocket of the pair of front pockets;

a front pocket bottom edge being spaced from the front pocket top edge, the front pocket bottom edge being positioned beneath the fly wherein each front pocket of the pair of front pockets has a length exceeding a length of the fly; and a plurality of cargo pockets being coupled to the pair of pants, each cargo pocket of the plurality of cargo pockets being positioned on the front panel, each cargo pocket of the plurality of cargo pockets being positioned on a respective one of the first leg portion and the second leg portion beneath the pair of front pockets, each cargo pocket of the plurality of cargo pockets being pleated wherein a volume of each cargo pocket of the plurality of cargo pockets is expandable, each cargo pocket of the plurality of cargo pockets including:

a cargo pocket flap being coupled to the pair of pants, the cargo pocket flap being pivotably coupled to the pair of pants above a respective cargo pocket of the plurality of cargo pockets wherein the cargo pocket flap is selectively pivotable downwardly toward the pair of pants to close the respective cargo pocket of the plurality of cargo pockets.

* * * * *